US006179102B1

(12) United States Patent
Weber et al.

(10) Patent No.: US 6,179,102 B1
(45) Date of Patent: Jan. 30, 2001

(54) TRAVEL ORGANIZER

(76) Inventors: Twyna Weber; Nancy L. Weber, both of P.O. Box 1611, Aldergrove, BC (CA), V4W 2V1

( * ) Notice: Under 35 U.S.C. 154(b), the term of this patent shall be extended for 0 days.

(21) Appl. No.: 09/335,162

(22) Filed: Jun. 17, 1999

(51) Int. Cl.[7] ..... A45C 5/06; A45C 5/12; A45C 15/02

(52) U.S. Cl. ..... 190/109; 190/108; 190/110; 190/112; 150/112; 150/117

(58) Field of Search ..... 190/102, 109, 190/110–112, 108; 150/112, 117, 149, 106

(56) References Cited

U.S. PATENT DOCUMENTS

| | | | | |
|---|---|---|---|---|
| 1,485,172 | * | 2/1924 | Dowell | 150/117 X |
| 1,723,740 | * | 8/1929 | Lewis | 150/106 |
| 2,299,873 | * | 10/1942 | Zolkind | 190/102 X |
| 2,331,428 | * | 10/1943 | Selezneff | 150/106 X |
| 3,537,552 | * | 11/1970 | Noble | 190/111 |
| 3,963,102 | * | 6/1976 | Carp | 150/106 X |
| 4,420,068 | * | 12/1983 | Gerch | 190/102 |
| 5,020,673 | * | 6/1991 | Adams | 150/117 X |
| 5,054,589 | * | 10/1991 | Bomes et al. | 190/111 X |
| 5,105,920 | * | 4/1992 | Grebenstein | 190/111 X |
| 5,178,246 | * | 1/1993 | Kramer | 190/111 X |
| 5,207,254 | * | 5/1993 | Fromm | 190/110 X |
| 5,911,262 | * | 6/1999 | Steinhart | 150/117 X |

FOREIGN PATENT DOCUMENTS

| | | | | |
|---|---|---|---|---|
| 23252 | * | 2/1906 | (AU) | 190/109 |
| 2000776 | * | 7/1971 | (DE) | 190/111 |
| 3418234 | * | 11/1984 | (DE) | 190/109 |
| 659112 | * | 10/1951 | (GB) | 190/109 |
| 1757609 | * | 8/1992 | (SU) | 190/109 |

* cited by examiner

*Primary Examiner*—Sue A. Weaver

(57) ABSTRACT

A travel organizer system is provided including an intermediate portion with a flexible carrying strap mounted thereon. A pair of side portions are hingably coupled to the intermediate portion each with a plurality of compartments formed therein for carrying various travel related items therein.

8 Claims, 4 Drawing Sheets

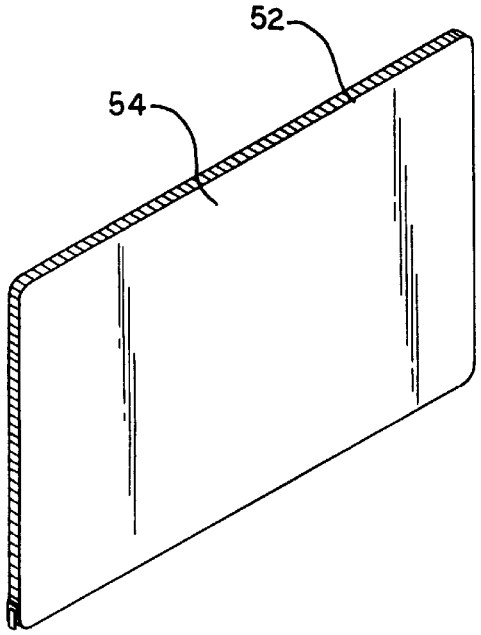
FIG. 5
FIG. 6
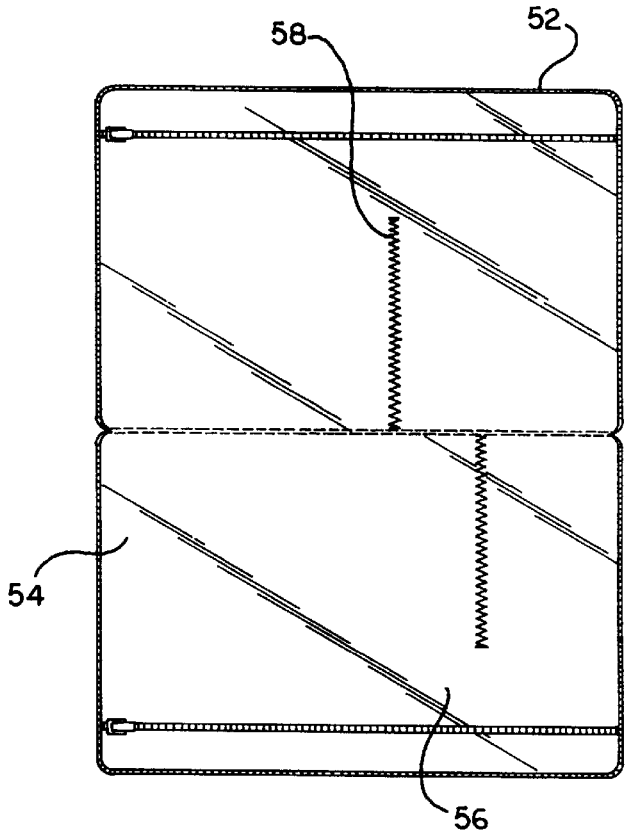
FIG. 7
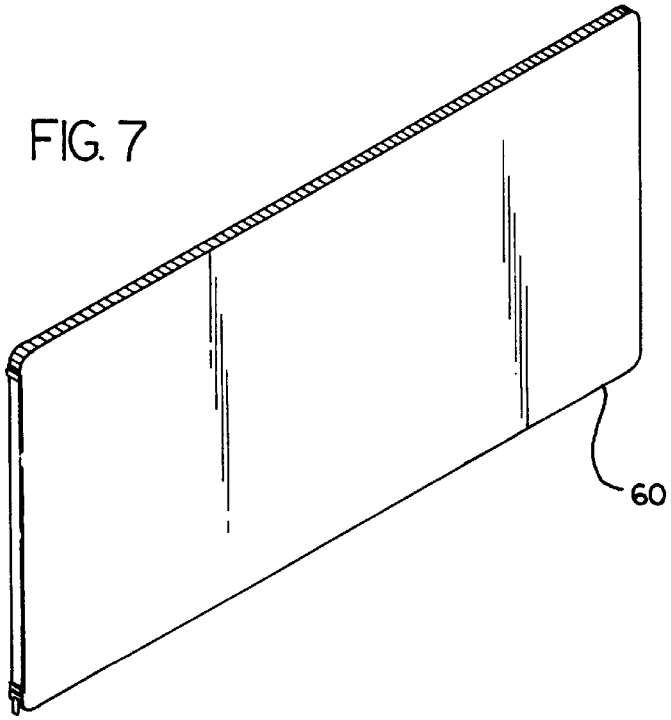

TRAVEL ORGANIZER

BACKGROUND OF THE INVENTION

1. Field of the Invention

The present invention relates to travel bags and more particularly pertains to a new travel organizer for containing toiletry items in a secure, conveniently accessible manner.

2. Description of the Prior Art

The use of travel bags is known in the prior art. More specifically, travel bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,152,307; U.S. Pat. No. Des. 389,647; U.S. Pat. No. Des. 359,163; U.S. Pat. No. 4,964,526; U.S. Pat. No. 4,887,751; and U.S. Pat. No. 2,068,547.

In these respects, the travel organizer according to the present invention substantially departs from the conventional concepts and designs of the prior art, and in so doing provides an apparatus primarily developed for the purpose of containing toiletry items in a secure, conveniently accessible manner.

SUMMARY OF THE INVENTION

In view of the foregoing disadvantages inherent in the known types of travel bags now present in the prior art, the present invention provides a new travel organizer construction wherein the same can be utilized for containing toiletry items in a secure, conveniently accessible manner.

The general purpose of the present invention, which will be described subsequently in greater detail, is to provide a new travel organizer apparatus and method which has many of the advantages of the travel bags mentioned heretofore and many novel features that result in a new travel organizer which is not anticipated, rendered obvious, suggested, or even implied by any of the prior art travel bags, either alone or in any combination thereof.

To attain this, the present invention generally comprises an intermediate portion having a rectangular configuration with an elongated top wall, an elongated bottom wall, and a pair of short end walls. As such, an interior space and a pair of side openings are defined. Each side opening has a peripheral edge with a zipper mounted along the top wall and the end walls. The intermediate portion further has a side wall mounted between the top wall, the bottom wall and the end walls adjacent to and spaced from the peripheral edge of each of the side openings. One of such side walls is preferably pivotably mounted on the intermediate portion. The intermediate portion further includes a plurality of interconnected dividers positioned between the side openings of the intermediate portion. By this structure, a plurality of compartments of different sizes and shapes are provided, as shown in FIG. 2. Each divider is equipped with a VELCRO fastener mounted between a central extent of opposite side edges thereof for containing an item therein. Next provided is a flexible adjustable carrying strap with a width approximately equal to that of the intermediate portion. The strap has a pair of ends with sleeves for receiving loops coupled to the end walls of the intermediate portion adjacent to the top wall thereof. A first side portion is included with a side wall and a peripheral wall coupled to the side wall and extending therefrom. The peripheral wall of the first side portion is defined by an elongated top wall, an elongated bottom wall, and a pair of short end walls having a peripheral edge. The peripheral edge of the first side portion is hingably coupled to the peripheral edge of the first side opening of the intermediate portion along the bottom walls thereof. The peripheral edge of the first side portion further has a zipper mounted along the top wall and the end walls thereof. Similar to the intermediate portion, the side wall of the first side portion has a plurality of interconnected dividers and compartments. Associated with the first side portion is a second side portion with structure similar to the first side portion except that a peripheral wall of the second side portion has a thickness ½ that of the first side portion. Further, the peripheral edge of the second side portion is hingably coupled to the peripheral edge of the second side opening of the intermediate portion along the bottom walls thereof. As shown in the various Figures, an auxiliary portion is equipped with an inboard extent including a peripheral wall coupled to the side wall of the second side portion and extending therefrom. The peripheral wall of the inboard extent has a width equal to that of the intermediate portion and a height which is about ¾ that of the intermediate portion. The peripheral wall of the inboard extent of the auxiliary portion is defined by an elongated top wall, an elongated bottom wall, and a pair of short end walls having a pleated edge. The peripheral edge of the inboard extent of the auxiliary portion has a zipper mounted along the top wall thereof for allowing access to the auxiliary portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new travel organizer apparatus and method which has many of the advantages of the travel bags mentioned heretofore and many novel features that result in a new travel organizer which is not anticipated, rendered obvious, suggested, or even implied by any of the prior art travel bags, either alone or in any combination thereof.

It is another object of the present invention to provide a new travel organizer which may be easily and efficiently manufactured and marketed.

It is a further object of the present invention to provide a new travel organizer which is of a durable and reliable construction.

An even further object of the present invention is to provide a new travel organizer which is susceptible of a low cost of manufacture with regard to both materials and labor, and which accordingly is then susceptible of low prices of sale to the consuming public, thereby making such travel organizer economically available to the buying public.

Still yet another object of the present invention is to provide a new travel organizer which provides in the apparatuses and methods of the prior art some of the advantages thereof, while simultaneously overcoming some of the disadvantages normally associated therewith.

Still another object of the present invention is to provide a new travel organizer for containing toiletry items in a secure, conveniently accessible manner.

Even still another object of the present invention is to provide a new travel organizer that includes an intermediate portion with a flexible adjustable carrying strap mounted thereon. A pair of side portions are hingably coupled to the intermediate portion each with a plurality of compartments formed therein for carrying various travel related items therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front view of the cosmetic case of the present invention in a closed orientation.

FIG. 6 is a front view of the cosmetic case of the present invention in an open orientation.

FIG. 7 is a front view of the manicure case of the present invention in a closed orientation.

DESCRIPTION OF THE PREFERRED EMBODIMENT

Figure 2:
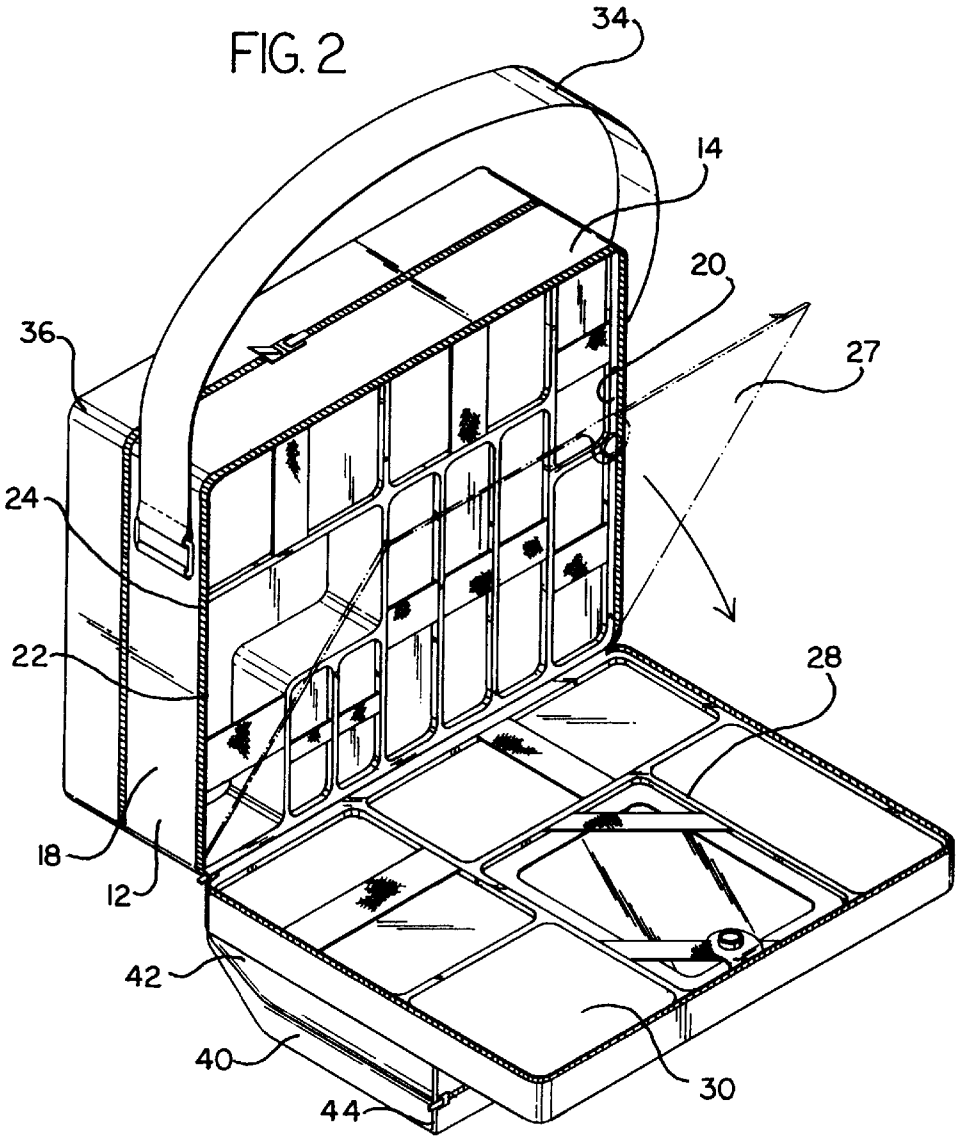
FIG. 2 is a perspective view of the present invention with the second side portion in an open orientation.
Figure 1:
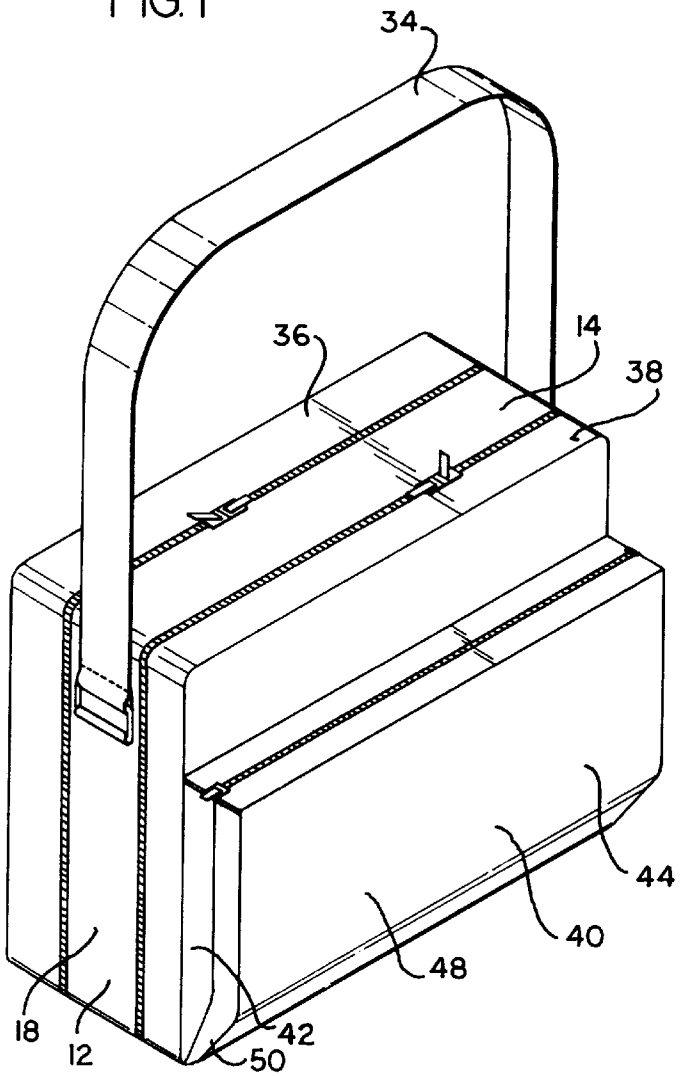
FIG. 1 is a front perspective view of a new travel organizer according to the present invention.

With reference now to the drawings, and in particular to FIGS. 1 through 9 thereof, a new travel organizer embodying the principles and concepts of the present invention and generally designated by the reference numeral 10 will be described.

The present invention, designated as numeral 10, includes an intermediate portion 12 having a rectangular configuration with an elongated top wall 14, an elongated bottom wall 16, and a pair of short end walls 18. As such, an interior space 20 and a pair of side openings 22 are defined. Each side opening has a peripheral edge 24 with a zipper mounted along the top wall and the end walls of the intermediate portion.

Figure 4:
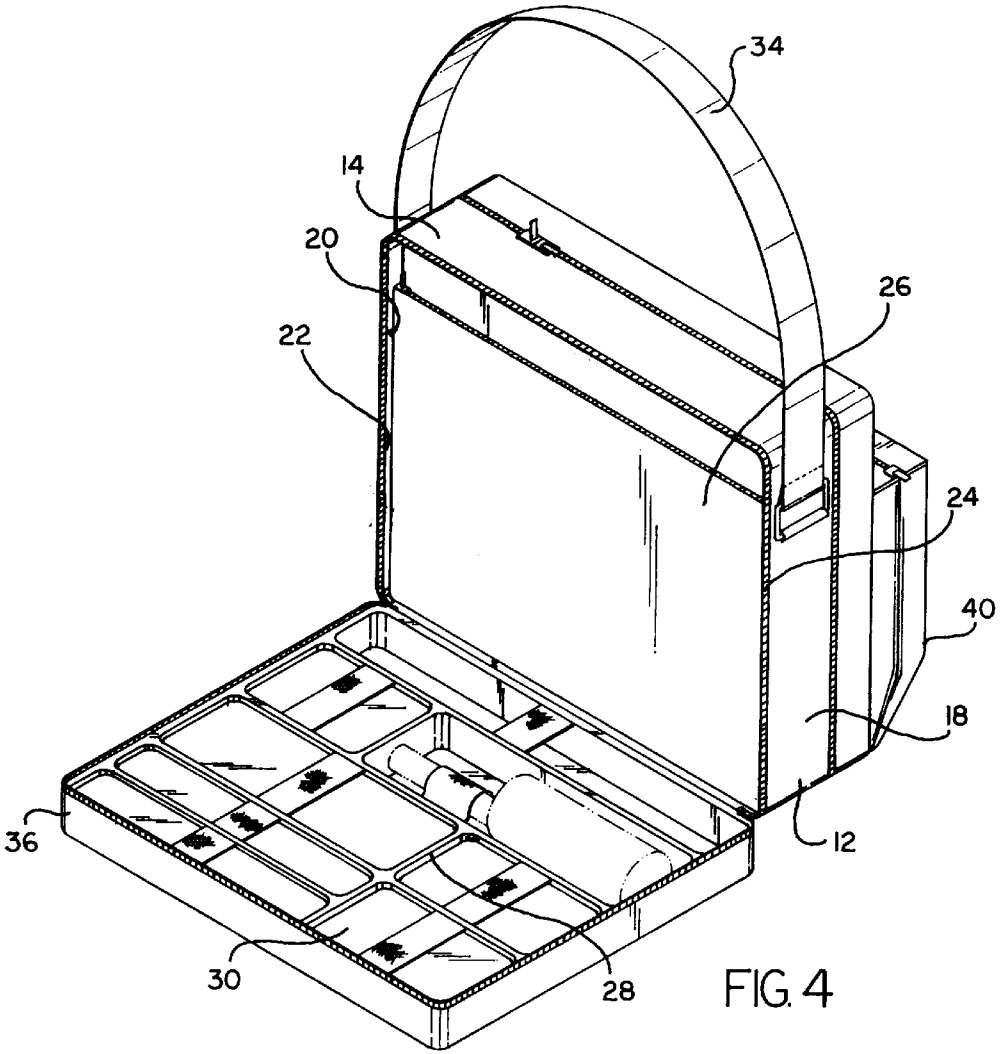
FIG. 4 is a perspective view of the present invention with the first side portion in an open orientation.
Figure 3:
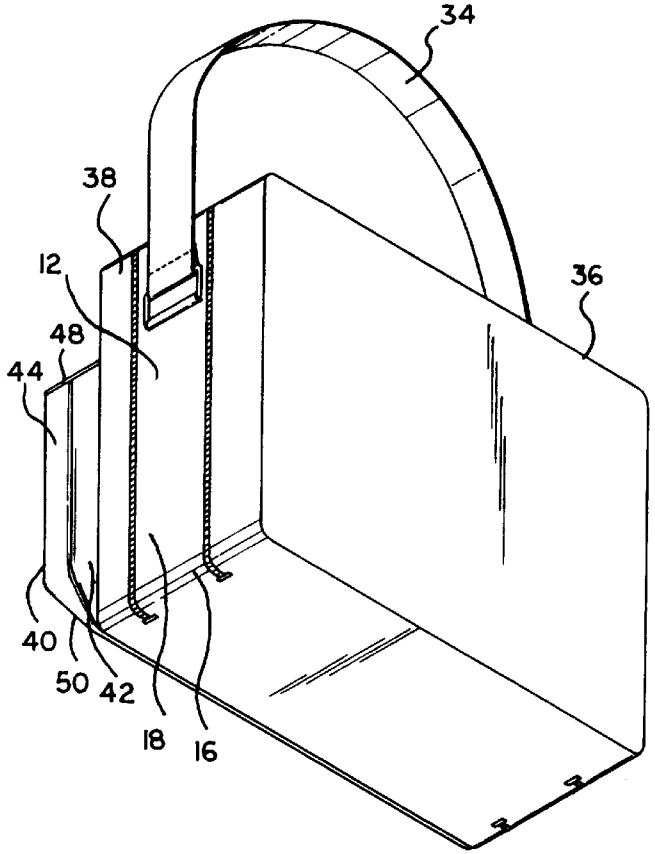
FIG. 3 is a rear perspective view of the present invention with the portions in a closed orientation.
Figure 8:
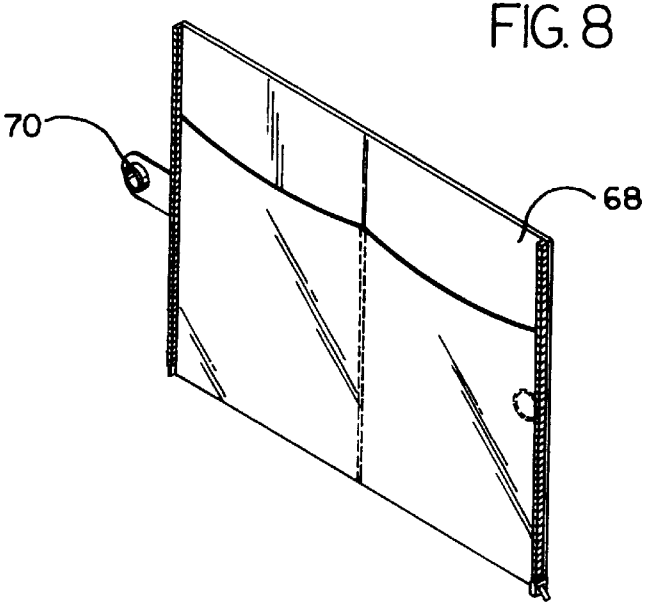
FIG. 8 is a front view of the sewing case of the present invention in an open orientation.

The intermediate portion further has a side wall 26 mounted between the top wall, the bottom wall and the end walls adjacent to and spaced from the peripheral edge of each of the side openings. Ideally, one of the side walls 27 is hingably coupled in place and may be fixedly snapped in place as shown in FIG. 2. The side wall which is fixed in place preferably has a pocket as shown in FIG. 4 with an opening selectively closed by a zipper. The intermediate portion further includes a plurality of interconnected dividers 28 positioned between the side openings. By this structure, a plurality of compartments 30 of different sizes and shapes are provided, as shown in FIG. 2. Each divider is equipped with a VELCRO fastener with the exception of the dividers which constrain a mirror, toothbrush, toothpaste, clippers, tweezers, sewing kit, brush/pic, etc. Such dividers are equipped with elastic fasteners in lieu of VELCRO fasteners. Each of the foregoing fasteners are mounted between a central extent of opposite side edges of the associated dividers for containing an item therein.

It should be noted that each of the compartments are specifically shaped for receiving a toiletry item such as shampoo, hair spray, toothbrush, etc. At least one of the compartments has a pair of elastic straps straddling a pair diagonally opposed corners for housing a mirror therein. Further, one of the compartments has an L-shaped configuration for housing a hair dryer.

Next provided is a flexible adjustable carrying strap 34 with a width approximately equal to that of the intermediate portion. The strap has a pair of ends with sleeves for receiving loops coupled to the end walls of the intermediate portion adjacent to the top wall thereof.

A first side portion 36 is included with a side wall and a peripheral wall coupled to the side wall and extending therefrom. The peripheral wall of the first side portion is defined by an elongated top wall, an elongated bottom wall, and a pair of short end walls having a peripheral edge. The peripheral edge of the first side portion is hingably coupled to the peripheral edge of the first side opening of the intermediate portion along the bottom walls thereof. The peripheral edge of the first side portion further has a zipper mounted along the top wall and the end walls thereof. Similar to the intermediate portion, the side wall of the first side portion has a plurality of interconnected dividers and compartments.

Associated with the first side portion is a second side portion 38 with structure similar to the first side portion except that a peripheral wall of the second side portion has a thickness ½ that of the first side portion. Further, the peripheral edge of the second side portion is hingably coupled to the peripheral edge of the second side opening of the intermediate portion along the bottom walls thereof.

As shown in the various Figures, an auxiliary portion 40 is equipped with an inboard extent 42 including a peripheral wall coupled to the side wall of the second side portion and extending therefrom. The peripheral wall of the inboard extent has a width equal to that of the intermediate portion and a height which is about ¾ that of the intermediate portion. The peripheral wall of the inboard extent of the auxiliary portion is defined by an elongated top wall, an elongated bottom wall, and a pair of short end walls having a peripheral edge. The peripheral edge of the inboard extent of the auxiliary portion has a zipper mounted along the top wall for allowing access to the pocket defined by the auxiliary portion. The end walls of the inboard extent of the auxiliary portion are preferably pleated, as shown in the Figures. The auxiliary portion of the system further includes an outboard wall 44. In addition, a stiff divider is preferably positioned within the auxiliary portion and connected to the bottom wall thereof. As such, a pair of adjustable compartments are defined for containment purposes. It should be noted that the divider is preferably of a size equal to that of the outboard wall.

It should be noted that the inboard extent and the outboard extent of the auxiliary portion each have an upper part 48 with a uniform constant thickness equal to that of the second side portion. Each extent of the auxiliary portion further has a lower part 50 with a tapering thickness.

As shown in FIGS. 5 & 6, a cosmetic case 52 is provided including a pair of planar rectangular members 54 each having a pair of elongated side edges and a pair of short end edges. A first one of the elongated side edges of the members is hingably coupled. Further, a second one of the elongated side edges and the short end edges of each member are lined with a zipper for selective closure, as shown in FIG. 5. Each member further has a clear plastic sheet 56 mounted on an interior surface thereof for defining a pocket with an open top spaced from the second side edge of the member. A zipper selectively closes the such pockets. As shown in FIG. 6, each sheet has a seam 58 coupling the plastic sheet to the member in parallel with the side edges for defining a pair differently sized subcompartments in the pocket. In use, the cosmetic case is adapted for being selectively positioned within one of the compartments of the portions.

Figure 9:
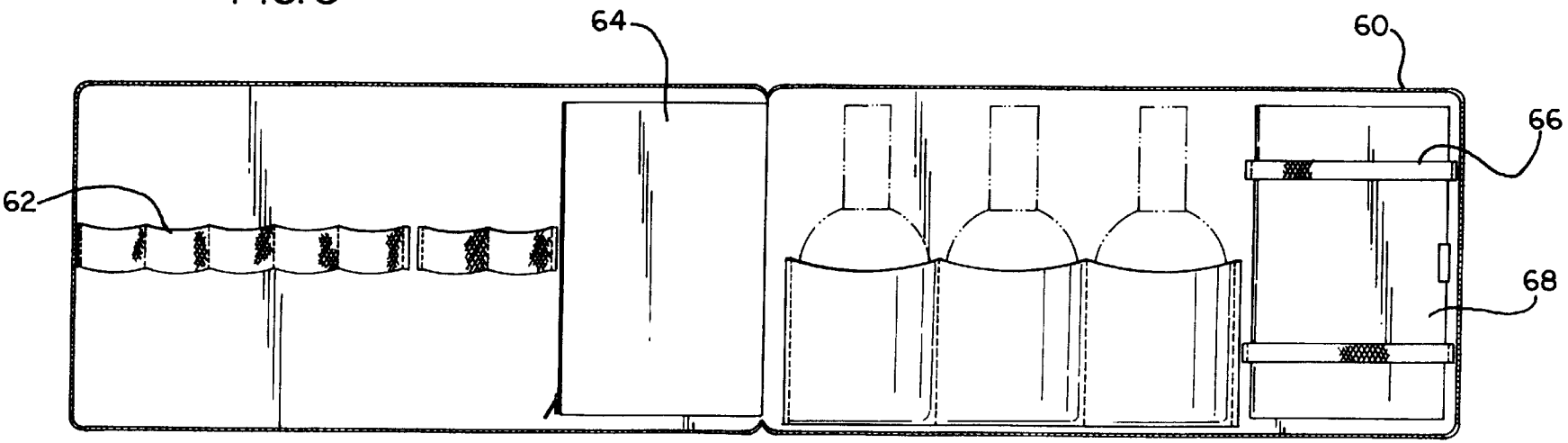
FIG. 9 is a front view of the manicure case of the present invention in an open orientation.

Yet another case that is included is a manicure case 60 having a pair of planar rectangular members similar to the cosmetic case. A first one of the short end edges of the members of the manicure case is hingably coupled with a second one of the short end edges thereof. Further, the elongated side edges are lined with a zipper for selective closure. See FIG. 7. As shown in FIG. 9, a first one of the members of the manicure case has a plurality of short elastic couples 62 mounted side-by-side adjacent the second end edge thereof for housing various devices such as files, tweezers, clippers, etc. Further, a pocket 64 is mounted adjacent the first end edge thereof with a zipper opening facing the second end edge. A second one of the members of the manicure case includes a plurality of pockets mounted side-by-side adjacent to the first end edge and each having an opening facing one of the side edges. These pockets are for housing nail polish and the like. A pair of parallel elongated elastic couples 66 are mounted adjacent to the second end edge of the second member. In use, the manicure case is adapted for being selectively positioned within one of the compartments of the portions.

Finally, a sewing case 68 is provided for being removably positioned between the elongated elastic couples of the second member of the manicure case. The sewing case includes a pair of planar rectangular members similar to the forgoing cases. A first one of the elongated side edges of the members of the sewing case is hingably coupled. Further, the second one of the elongated side edges has a snap coupling 70 for selectively closure of the sewing case. Each member further has a clear plastic sheet mounted on an interior surface thereof for defining a pocket with an open top spaced from the second side edge of the member and having a zipper selectively closing the same. Ideally, each empty container in the present invention are manufactured and labeled to match the corresponding section.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A travel organizer system comprising, in combination:

an intermediate portion having a rectangular configuration with an elongated top wall, an elongated bottom wall, and a pair of short end walls defining an interior space and a pair of side openings each having a peripheral edge with a zipper mounted along the top wall and the end walls, the intermediate portion having a side wall mounted between the top wall, the bottom wall and the end walls adjacent to and spaced from the peripheral edge of a second one of the side openings, the intermediate portion having a plurality of interconnected dividers positioned between the side openings of the intermediate portion thereby defining a plurality of compartments of different sizes and shapes and each with a fastener mounted between a central extent of opposite side edges thereof for containing an item therein;

a flexible and adjustable carrying strap with a width approximately equal to that of the intermediate portion and having a pair of ends with sleeves for receiving loops coupled to the end walls of the intermediate portion adjacent to the top wall thereof;

a first side portion with a side wall and a peripheral wall coupled to the side wall and extending therefrom and defined by an elongated top wall, an elongated bottom wall, and a pair of short end walls having a peripheral edge, the peripheral edge of the first side portion hingably coupled to the peripheral edge of the first side opening of the intermediate portion along the bottom walls thereof, the peripheral edge of the first side portion having a zipper mounted along the top wall and the end walls thereof, the side wall of the first side portion having a plurality of interconnected dividers coupled thereto and extending therefrom to a point adjacent to and spaced from the peripheral edge thereof thereby defining a plurality of compartments;

a second side portion with a side wall and a peripheral wall coupled to the side wall and extending therefrom wherein the peripheral wall of the second side portion has a thickness ½ that of the first side portion and is defined by an elongated top wall, an elongated bottom wall, and a pair of short end walls having a peripheral edge, the peripheral edge of the second side portion hingably coupled to the peripheral edge of the second side opening of the intermediate portion along the bottom walls thereof, the peripheral edge of the second side portion having a zipper mounted along the top wall and the end walls thereof, the side wall of the second side portion having a plurality of interconnected dividers coupled thereto and extending therefrom to a point adjacent to and spaced from the peripheral edge of the second side portion thereby defining a plurality of compartments;

an auxiliary portion with an inboard extent including a peripheral wall coupled to the side wall of the second side portion and extending therefrom wherein the peripheral wall of the inboard extent has a width equal to that of the intermediate portion and a height which is about ¾ that of the intermediate portion and is defined by an elongated top wall, an elongated bottom wall, and a pair of short end walls having a pleated edge, the peripheral edge of the inboard extent of the auxiliary portion having a zipper mounted along the top wall;

a cosmetic case including a pair of planar rectangular members each including a pair of elongated side edges and a pair of short end edges a first one of the elongated side edges of the members being hingably coupled with the second one of the elongated side edges and the short end edges being lined with a zipper for selective closure, each member further having a clear plastic sheet mounted on an interior surface thereof for defining a pocket with an open top spaced from the second side edge of the member and having a zipper selectively closing the same, wherein each sheet has a seam coupling the plastic sheet to the member in parallel with the side edges for defining a pair differently sized subcompartments in the pocket, wherein the cosmetic case is adapted for being selectively positioned within one of the compartments of the portions;

a manicure case including a pair of planar rectangular members each having a pair of elongated side edges and a pair of short end edges, a first one of the short end edges of the members being hingably coupled with a second one of the short end edges and the elongated side edges being lined with a zipper for selective closure, a first one of the members of the manicure case having a plurality of short elastic couples mounted side-by-side adjacent the second end edge thereof and a pocket mounted adjacent the first end edge thereof with a zipper opening facing the second end edge, a second one of the members of the manicure case including a plurality of pockets mounted side-by-side adjacent to the first end edge and each having an opening facing one of the side edges and a pair of parallel elongated elastic couples mounted adjacent to the second end edge thereof, wherein the manicure case is adapted for being selectively positioned within one of the compartments of the portions; and a sewing case including a pair of planar rectangular members each having a pair of elongated side edges and a pair of short end edges, a first one of the elongated side edges of the members being hingably coupled and the second one of the elongated side edges having a snap coupling for selectively closure of the sewing case, each member further having a clear plastic sheet mounted on an interior surface thereof for defining a pocket with an open top spaced from the second side edge of the member and having a zipper selectively closing the same.

2. A travel organizer system comprising:

an intermediate portion, said intermediate portion being located adjacent to both the first and second side portions, said intermediate portion having a top wall, a bottom wall, and a pair of end walls defining an interior space and a pair of side openings each having a peripheral edge with a zipper mounted along the top wall and the end walls, the intermediate portion having a side wall mounted between the top wall, the bottom wall and the end walls adjacent to and spaced from the peripheral edge of a second one of the side openings, the intermediate portion having a plurality of interconnected dividers positioned between the side openings of the intermediate portion thereby defining a plurality of compartments of different sizes and shapes and each with a fastener mounted between a central extent of opposite side edges thereof for containing an item therein;

a first side portion, said first side portion having a side wall and a peripheral wall coupled to the side wall and extending therefrom and defined by a top wall, a bottom wall, and a pair of end walls having a peripheral edge, the peripheral edge of the first side portion hingably coupled to the peripheral edge of the first side opening of the intermediate portion along the bottom walls thereof, the peripheral edge of the first side portion having a zipper mounted along the top wall and the end walls thereof, the side wall of the first side portion having a plurality of interconnected dividers coupled thereto and extending therefrom to a point adjacent to and spaced from the peripheral edge thereof thereby defining a plurality of compartments; and a second side portion, the second side portion having a side wall and a peripheral wall coupled to the side wall and extending therefrom an elongated bottom wall, and a pair of short end walls having a peripheral edge, the peripheral edge of the second side portion hingably coupled to the peripheral edge of the second side opening of the intermediate portion along the bottom walls thereof, the peripheral edge of the second side portion having a zipper mounted along the top wall and the end walls thereof, the side wall of the second side portion having a plurality of interconnected dividers coupled thereto and extending therefrom to a point adjacent to and spaced from the peripheral edge of the second side portion thereby defining a plurality of compartments.

3. The travel organizer system of claim 2, further comprising a flexible and adjustable carrying strap having a pair of ends with sleeves for receiving loops coupled to the end walls of the intermediate portion adjacent to the top wall thereof.

4. The travel organizer system of claim 2, further comprising an auxiliary portion, said auxiliary portion having an inboard extent including a peripheral wall coupled to the side wall of the second side portion and extending therefrom an elongated bottom wall, and a pair of end walls having a pleated edge, the peripheral edge of the inboard extent of the auxiliary portion having a zipper mounted along the top wall.

5. The travel organizer system of claim 2, further comprising a cosmetic case, said cosmetic case including a pair of planar members each including a pair of side edges and a pair of end edges, a first one of the side edges of the members being hingably coupled with the second one of the side edges and the end edges being lined with a zipper for selective closure, each member further having a clear plastic sheet mounted on an interior surface thereof for defining a pocket with an open top spaced from the second side edge of the member and having a zipper selectively closing the same, wherein each sheet has a seam coupling the plastic sheet to the member in parallel with the side edges for defining a pair of differently sized subcompartments in the pocket, wherein the cosmetic case is adapted for being selectively positioned within one of the compartments of the portions.

6. The travel organizers system of claim 2, further comprising a manicure case, said manicure case including a pair of planar rectangular members each having a pair of elongated side edges and a pair of short end edges, a first one of the short end edges of the members being hingably coupled with a second one of the short end edges and the elongated side edges being lined with a zipper for selective closure, a first one of the members of the manicure case having a plurality of short elastic couples mounted side-by-side adjacent the second end edge thereof and a pocket mounted adjacent the first end edge thereof with a zipper opening facing the second end edge, a second one of the members of the manicure case including a plurality of pockets mounted side-by-side adjacent to the first end edge and each having an opening facing one of the side edges and a pair of parallel elongated elastic couples mounted adjacent to the second end edge thereof, wherein the manicure case is adapted for being selectively positioned within one of the compartments of the portions.

7. The travel organizer system of claim 2, further comprising a sewing case, said sewing case including a pair of planar rectangular members each having a pair of elongated side edges and a pair of short end edges, a first one of the elongated side edges of the members being hingably coupled and the second one of the elongated side edges having a snap coupling for selectively closure of the sewing case, each member further having a clear plastic sheet mounted on an interior surface thereof for defining a pocket with an open top spaced from the second side edge of the member and having a zipper selectively closing the same.

8. The travel organizer system of claim 2, further comprising an auxiliary portion, said auxiliary portion having an inboard extent including a peripheral wall coupled to the side wall of the second side portion and extending therefrom an elongated bottom wall, and a pair of end walls having a pleated edge, the peripheral edge of the inboard extent of the auxiliary portion having a zipper mounted along the top wall;

a cosmetic case, said cosmetic case including a pair of planar members each including a pair of side edges and a pair of end edges, a first one of the side edges of the members being hingably coupled with the second one of the side edges and the end edges being lined with a zipper for selective closure, each member further having a clear plastic sheet mounted on an interior surface thereof for defining a pocket with an open top spaced from the second side edge of the member and having a zipper selectively closing the same, wherein each sheet has a seam coupling the plastic sheet to the member in parallel with the side edges for defining a pair of differently sized subcompartments in the pocket, wherein the cosmetic case is adapted for being selectively positioned within one of the compartments of the portions;

a manicure case, said manicure case including a pair of planar rectangular members each having a pair of elongated side edges and a pair of short end edges, a first one of the short end edges of the members being hingably coupled with a second one of the short end edges and the elongated side edges being lined with a zipper for selective closure, a first one of the members of the manicure case having a plurality of short elastic couples mounted side-by-side adjacent the second end edge thereof and a pocket mounted adjacent the first end edge thereof with a zipper opening facing the second end edge, a second one of the members of the manicure case including a plurality of pockets mounted side-by-side adjacent to the first end edge and each having an opening facing one of the side edges and a pair of parallel elongated elastic couples mounted adjacent to the second end edge thereof, wherein the manicure case is adapted for being selectively positioned within one of the compartments of the portions; and a sewing case, said sewing case including a pair of planar rectangular members each having a pair of elongated side edges and a pair of short end edges, a first one of the elongated side edges of the members being hingably coupled and the second one of the elongated side edges having a snap coupling for selectively closure of the sewing case, each member further having a clear plastic sheet mounted on an interior surface thereof for defining a pocket with an open top spaced from the second side edge of the member and having a zipper selectively closing the same.

* * * * *